US006910234B1

(12) United States Patent
Thulin

(10) Patent No.: US 6,910,234 B1
(45) Date of Patent: Jun. 28, 2005

(54) COLLAPSIBLE HEADBOARD

(76) Inventor: Steve Thulin, 44 Center Grove Rd., Apt. C-20, Randolph, NJ (US) 07869

( * ) Notice: Subject to any disclaimer, the term of this patent is extended or adjusted under 35 U.S.C. 154(b) by 0 days.

(21) Appl. No.: 10/389,206

(22) Filed: Mar. 14, 2003

(51) Int. Cl.[7] ..... A47C 20/00
(52) U.S. Cl. ..... 5/178; 5/53.1
(58) Field of Search ..... 5/658, 53.1, 178, 5/132, 159.1

(56) References Cited

U.S. PATENT DOCUMENTS 4,821,349 A * 4/1989 Cohen ..... 5/53.1
5,075,910 A * 12/1991 Morten ..... 5/53.1
5,269,032 A * 12/1993 Flocks ..... 5/53.1
5,790,994 A * 8/1998 Leonard ..... 5/53.1
6,370,715 * 4/2002 Morton ..... 5/655

* cited by examiner

*Primary Examiner*—Frederick L. Lagman

(57) ABSTRACT

A collapsible headboard for providing a headboard for a mattress to inhibit pillows falling off of the mattress. The collapsible headboard includes a frame assembly being selectively actuated between a collapsed position and a deployed position. The frame assembly is designed for receiving the mattress when the frame assembly is in the deployed position. The frame assembly is actuated to the collapsed position for facilitating storage of the frame assembly when the frame assembly is removed from the mattress. A panel member is coupled to the frame assembly. The panel member is designed for being positioned against the mattress whereby the panel member is for inhibiting pillows from sliding off of the mattress when the frame assembly is in the deployed position.

20 Claims, 3 Drawing Sheets

COLLAPSIBLE HEADBOARD

BACKGROUND OF THE INVENTION

1. Field of the Invention

The present invention relates to bed systems and more particularly pertains to a new collapsible headboard for providing a headboard for a mattress to inhibit pillows falling off of the mattress.

2. Description of the Prior Art

The use of bed systems is known in the prior art. U.S. Pat. No. 5,126,768 describes a system for providing a bed with a fixed headboard. Another type of bed system is U.S. Pat. No. 3,256,533 having a lounge that is convertible into a bed for a user to sleep on. U.S. Pat. No. 3,171,139 has a backrest that is coupled to a headboard for supporting a user in an inclined or sitting position of a user positioned on the bed.

While these devices fulfill their respective, particular objectives and requirements, the need remains for a device that has certain improved features allowing for the headboard to the removed from the mattress and easily stored.

SUMMARY OF THE INVENTION

The present invention meets the needs presented above by providing a frame assembly with side portions of the side members that are pivotally coupled to each other to allow the frame assembly to be actuated between a deployed position and a collapsed position.

Still yet another object of the present invention is to provide a new collapsible headboard that is convenient for use with an air mattress to inhibit the pillows from being pushed off the mattress while the user is sleeping.

Even still another object of the present invention is to provide a new collapsible headboard that is conveniently stored and transported for use in remote locations such as when the user is camping.

To this end, the present invention generally comprises a frame assembly being selectively actuated between a collapsed position and a deployed position. The frame assembly is designed for receiving the mattress when the frame assembly is in the deployed position. The frame assembly is actuated to the collapsed position for facilitating storage of the frame assembly when the frame assembly is removed from the mattress. A panel member is coupled to the frame assembly. The panel member is designed for being positioned against the mattress whereby the panel member is for inhibiting pillows from sliding off of the mattress when the frame assembly is in the deployed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
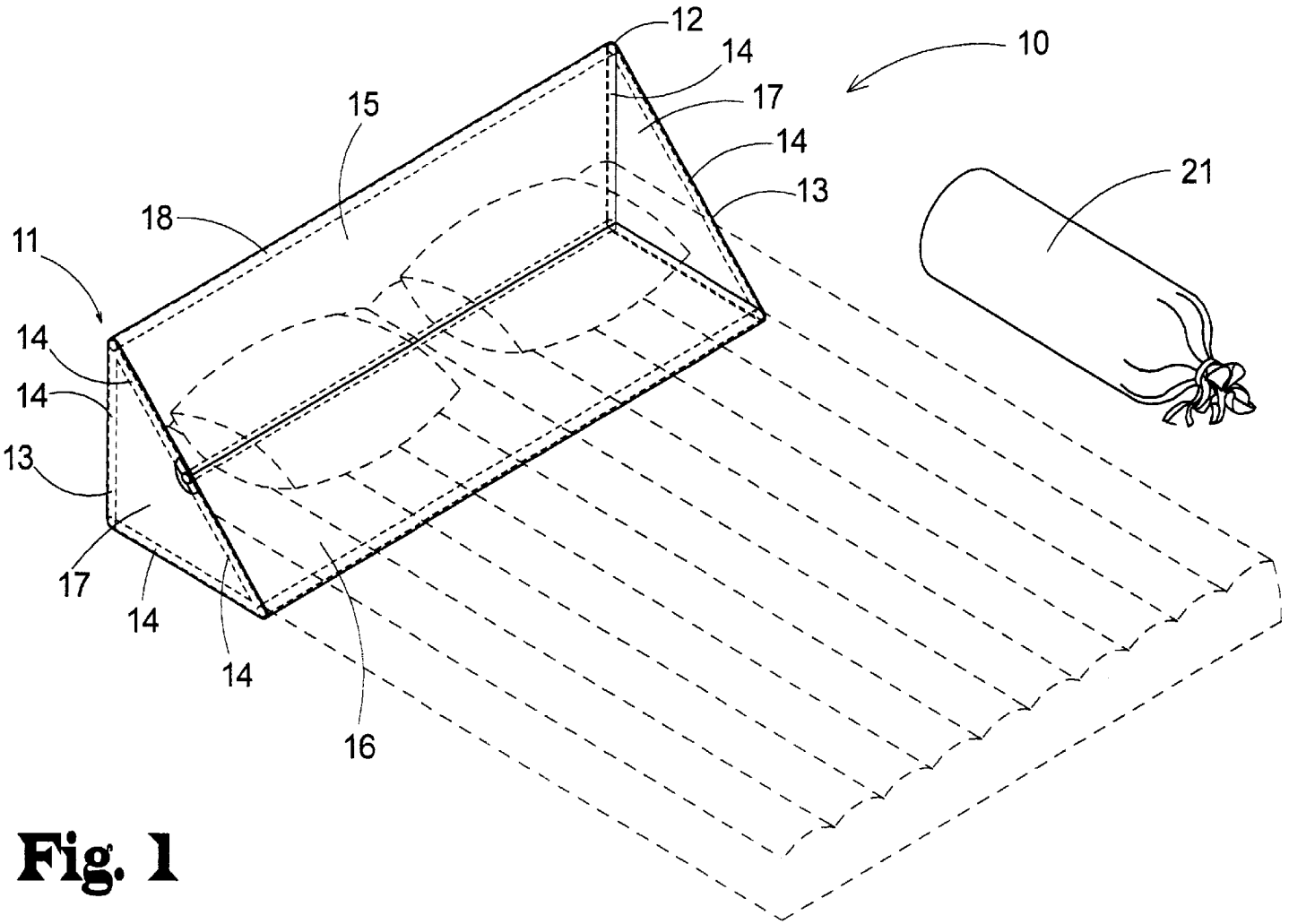
FIG. 1 is a perspective view of a new collapsible headboard according to the present invention shown in use.
Figure 2:
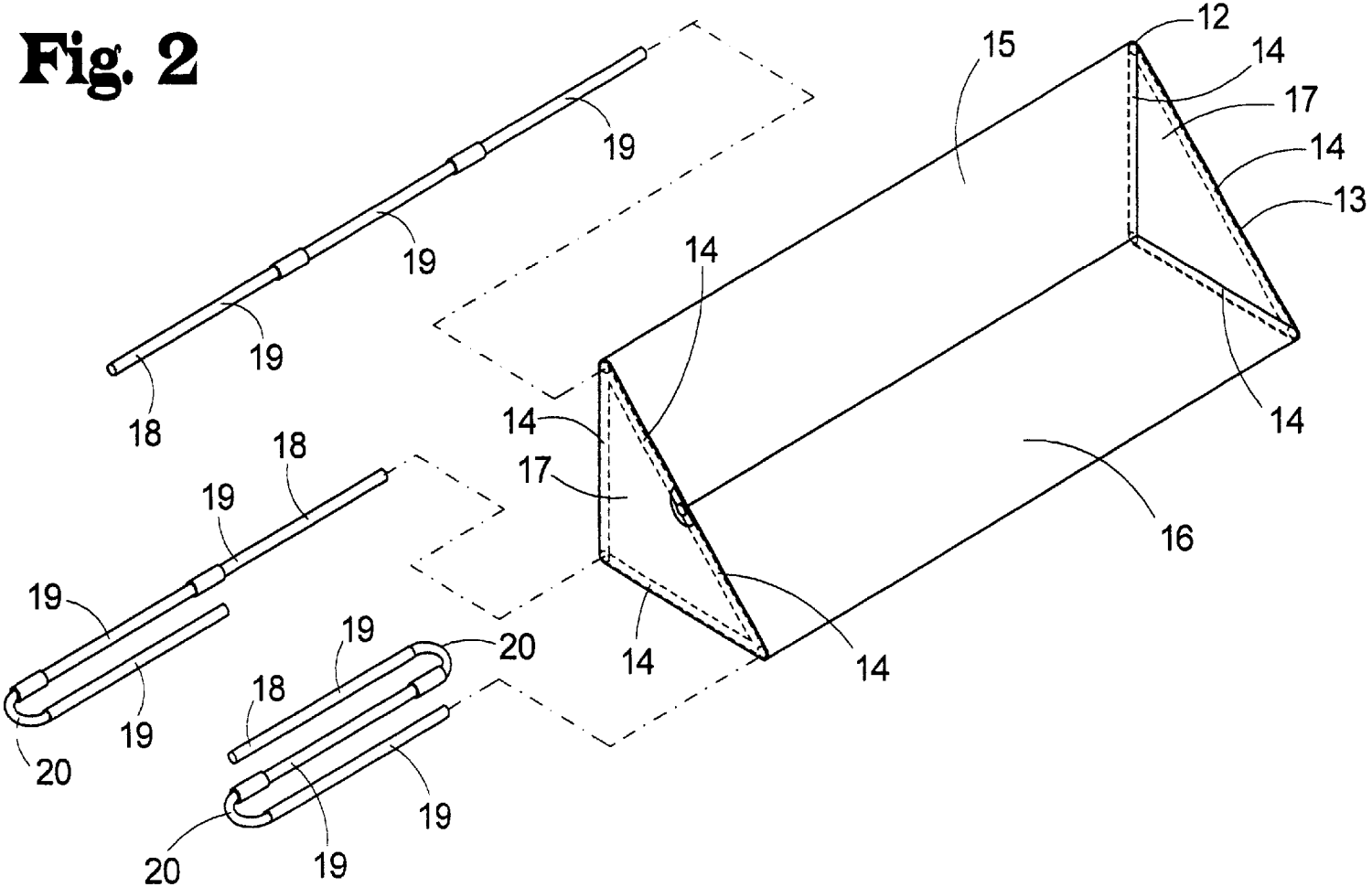
FIG. 2 is an exploded perspective view of the present invention.
Figure 3:
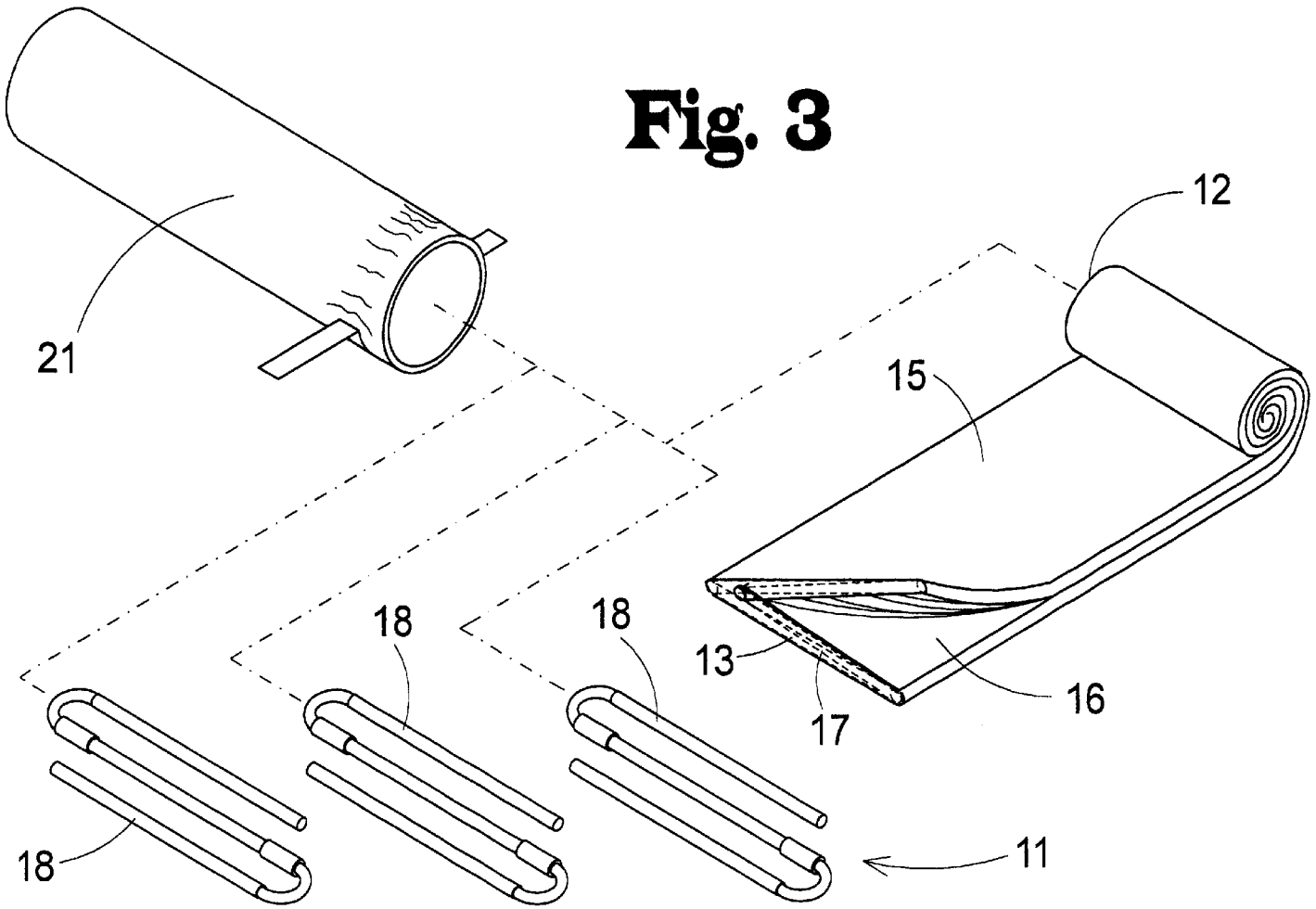
FIG. 3 is a perspective view of the present invention shown in the collapsed position.

With reference now to the drawings, and in particular to FIGS. 1 through 3 thereof, a new collapsible headboard embodying the principles and concepts of the present invention and generally designated by the reference numeral 10 will be described.

As best illustrated in FIGS. 1 through 3, the collapsible headboard 10 generally comprises a frame assembly 11 being selectively actuated between a collapsed position and a deployed position. The frame assembly 11 is designed for receiving the mattress when the frame assembly 11 is in the deployed position. The frame assembly 11 is actuated to the collapsed position for facilitating storage of the frame assembly 11 when the frame assembly 11 is removed from the mattress.

A panel member 12 is coupled to the frame assembly 11. The panel member 12 is designed for being positioned against the mattress whereby the panel member 12 is for inhibiting pillows from sliding off of the mattress when the frame assembly 11 is in the deployed position.

The frame assembly 11 comprises a pair of side members 13. Each of the side members 13 is positioned in a spaced relationship whereby the panel member 12 extends between the side members 13 of the frame assembly 11. Each of the side members 13 is designed for being positioned on opposite sides of the mattress whereby the side members 13 position the panel member 12 against the mattress to inhibit the pillows from falling off the mattress when the frame assembly 11 is in the deployed position.

Each of the side members 13 comprises a plurality of side portions 14. Each of the side portions 14 is pivotally coupled to an adjacent one of the side portions 14 whereby the side portions 14 pivot with respect to each other to permit the frame assembly 11 to be actuated between the deployed position and the collapsed position.

The panel member 12 comprises a backing panel portion 15. The backing panel portion 15 extends between the side members 13 of the frame assembly 11. The backing panel portion 15 is designed for extending upwardly from a support surface whereby the backing panel portion 15 is positioned adjacent a head of the mattress to inhibit the pillows from being pushed off the head of the mattress when the frame assembly 11 is in the deployed position.

The panel member 12 comprises a bottom panel portion 16. The bottom panel portion 16 extends between the side members 13 of the frame assembly 11. The bottom panel portion 16 is designed for being positioned parallel to the support surface whereby the bottom panel portion 16 is for being positioned under the mattress to inhibit movement of the frame assembly 11 and the panel member 12 with respect to the mattress when the frame assembly 11 is in the deployed position. The bottom panel portion 16 of the panel member 12 comprises a friction enhancing material. The friction enhancing material is designed for increasing friction between the bottom panel portion 16 and the mattress to inhibit the mattress from sliding on the bottom panel portion 16.

The panel member 12 comprises a pair of side panel portions 17. Each of the side members 13 of the frame assembly 11 is positioned in the side panel portions 17 of the panel member 12 whereby the side panel portions 17 are designed for inhibiting portions of a user becoming pinched by the side members 13 when the frame assembly 11 is actuated between the deployed position and the collapsed position.

The frame assembly 11 comprises a plurality of frame members 18. Each of the frame members 18 is extended through the side members 13 and the panel member 12 whereby the frame members 18 maintain the spaced relationship of the side members 13 of the frame assembly 11. The frame members 18 are removed from the side members 13 and the panel member 12 when the frame assembly 11 is being actuated to the collapsed position.

Each of the frame members 18 comprises a plurality of frame portions 19. Each of the frame portions 19 is selectively coupled to at least one other of the frame portions 19 of the associated one of the frame members 18 to form the associated one of the frame members 18 to be extended through the side members 13 and the panel member 12 when the frame assembly 11 is being actuated to the deployed position. The frame portions 19 of each of the frame members 18 are separated when the frame assembly 11 is actuated to the collapsed position.

Each of the frame members 18 comprises at least one elastic member 20. The elastic member 20 is coupled to the frame portions 19 of each of the frame members 18. The elastic member 20 is for inhibiting loss of one of the frame portions 19 from the associated one of the frame members 18 when the frame portions 19 are separated.

The panel member 12 comprises a flexible material. The flexible material is folded to facilitate storage of the panel member 12 when the frame assembly 11 is actuated to the collapsed position.

A bag member 21 selectively receives the panel member 12 and the frame assembly 11 when the frame assembly 11 has been actuated to the collapsed position. The bag member 21 facilitates storing of the panel member 12 and the frame assembly 11 when the frame assembly 11 and the panel member 12 are not in use.

In use, the user removes the frame assembly 11 and the pane member from the bag. The side portions 14 of each of the side members 13 is pivoted to the deployed position. The frame portions 19 of the associated frame members 18 are coupled together and inserted through the side members 13 and through the panel member 12 to provide more stability to the panel member 12. The mattress is then positioned on the bottom panel portion 16 between the side members 13 with the backing panel portion 15 being positioned to provide a temporary headboard for a mattress. The procedure is reversed to collapse the headboard for transport and storage.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible headboard for use with a mattress to keep pillows on the mattress, the collapsible headboard comprising:

a frame assembly being selectively actuated between a collapsed position and a deployed position, said frame assembly being adapted for receiving the mattress when said frame assembly is in said deployed position, said frame assembly being actuated to said collapsed position for facilitating storage of said frame assembly when said frame assembly is removed from the mattress;

a panel member being coupled to said frame assembly, said panel member being adapted for being positioned against the mattress such that said panel member is for inhibiting pillows from sliding off of the mattress when said frame assembly is in said deployed position; and said panel member comprising a backing panel portion and a bottom panel portion, said backing panel portion being coupled to said bottom panel portion such that said backing panel portion extends at an angle from said bottom panel portion when said frame assembly is in said deployed position, said bottom panel member being adapted for being positioned under the mattress such that said backing panel portion extends upwardly behind the mattress to inhibit pillows sliding off of the mattress.

2. The collapsible headboard as set forth in claim 1, further comprising:

said frame assembly comprising a pair of side members, each of said side members being positioned in a spaced relationship such that said panel member extends between said side members of said frame assembly, each of said side members being adapted for being positioned on opposite sides of the mattress such that said side members position said panel member against the mattress to inhibit the pillows from falling off the mattress when said frame assembly is in said deployed position.

3. The collapsible headboard as set forth in claim 2, further comprising:

each of said side members comprising a plurality of side portions, each of said side portions being pivotally coupled to an adjacent one of said side portions such that said side portions pivot with respect to each other to permit said frame assembly to be actuated between said deployed position and said collapsed position.

4. The collapsible headboard as set forth in claim 2, further comprising:

said backing panel portion of said panel member extending between said side members of said frame assembly, said backing panel portion being adapted for extending upwardly from a support surface such that said backing panel portion is positioned adjacent a head of the mattress to inhibit the pillows from being pushed off the head of the mattress when said frame assembly is in said deployed position.

5. The collapsible headboard as set forth in claim 2, further comprising:

said bottom panel portion of said panel member extending between said side members of said frame assembly, said bottom panel portion being adapted for being positioned parallel to the support surface such that said bottom panel portion is for being positioned under the mattress to inhibit movement of said frame assembly and said panel member with respect to the mattress when said frame assembly is in said deployed position.

6. The collapsible headboard as set forth in claim 5, further comprising:

said bottom panel portion of said panel member comprising a friction enhancing material, said friction enhancing material being adapted for increasing friction between said bottom panel portion and the mattress to inhibit the mattress from sliding on said bottom panel portion.

7. The collapsible headboard as set forth in claim 2, further comprising:

said panel member comprising a pair of side panel portions, each of said side members of said frame assembly being positioned in said side panel portions of said panel member such that said side panel portions are adapted for inhibiting portions of a user becoming pinched by said side members when said frame assembly is actuated between said deployed position and said collapsed position.

8. The collapsible headboard as set forth in claim 2, further comprising:

said frame assembly comprising a plurality of frame members, each of said frame members being extended through said side members and said panel member such that said frame members maintain the spaced relationship of said side members of said frame assembly, said frame members being removed from said side members and said panel member when said frame assembly is being actuated to said collapsed position.

9. The collapsible headboard as set forth in claim 8, further comprising:

each of said frame members comprising a plurality of frame portions, each of said frame portions being selectively coupled to at least one other of said frame portions of the associated one of said frame members to form the associated one of said frame members to be extended through said side members and said panel member when said frame assembly is being actuated to said deployed position, said frame portions of each of said frame members being separated when said frame assembly is actuated to said collapsed position.

10. The collapsible headboard as set forth in claim 9, further comprising:

each of said frame members comprising at least one elastic member, said elastic member being coupled to said frame portions of each of said frame members, said elastic member being for inhibiting loss of one of said frame portions from the associated one of said frame members when said frame portions are separated.

11. The collapsible headboard as set forth in claim 1, farther comprising:

said panel member comprising a flexible material, said flexible material being folded to facilitate storage of said panel member when said frame assembly is actuated to said collapsed position.

12. The collapsible headboard as set forth in claim 1, further comprising:

a bag member selectively receiving said panel member and said frame assembly when said frame assembly has been actuated to said collapsed position, said bag member facilitating storing of said panel member and said frame assembly when said frame assembly and said panel member are not in use.

13. A collapsible headboard for use with a mattress to keep pillows on the mattress, the collapsible headboard comprising:

a frame assembly being selectively actuated between a collapsed position and a deployed position, said frame assembly being adapted for receiving the mattress when said frame assembly is in said deployed position, said frame assembly being actuated to said collapsed position for facilitating storage of said frame assembly when said frame assembly is removed from the mattress;

a panel member being coupled to said frame assembly, said panel member being adapted for being positioned against the mattress such that said panel member is for inhibiting pillows from sliding off of the mattress when said frame assembly is in said deployed position;

said frame assembly comprising a pair of side members, each of said side members being positioned in a spaced relationship such that said panel member extends between said side members of said frame assembly, each of said side members being adapted for being positioned on opposite sides of the mattress such that said side members position said panel member against the mattress to inhibit the pillows from falling off the mattress when said frame assembly is in said deployed position;

each of said side members comprising a plurality of side portions, each of said side portions being pivotally coupled to an adjacent one of said side portions such that said side portions pivot with respect to each other to permit said frame assembly to be actuated between said deployed position and said collapsed position;

said panel member comprising a backing panel portion, said backing panel portion extending between said side members of said frame assembly, said backing panel portion being adapted for extending upwardly from a support surface such that said backing panel portion is positioned adjacent a head of the mattress to inhibit the pillows from being pushed off the head of the mattress when said frame assembly is in said deployed position;

said panel member comprising a bottom panel portion, said bottom panel portion extending between said side members of said frame assembly, said bottom panel portion being adapted for being positioned parallel to the support surface such that said bottom panel portion is for being positioned under the mattress to inhibit movement of said frame assembly and said panel member with respect to the mattress when said frame assembly is in said deployed position;

said bottom panel portion of said panel member comprising a friction enhancing material, said friction enhancing material being adapted for increasing friction between said bottom panel portion and the mattress to inhibit the mattress from sliding on said bottom panel portion;

said panel member comprising a pair of side panel portions, each of said side members of said frame assembly being positioned in said side panel portions of said panel member such that said side panel portions are adapted for inhibiting portions of a user becoming pinched by said side members when said frame assembly is actuated between said deployed position and said collapsed position;

said frame assembly comprising a plurality of frame members, each of said frame members being extended through said side members and said panel member such that said frame members maintain the spaced relationship of said side members of said frame assembly, said frame members being removed from said side members and said panel member when said frame assembly is being actuated to said collapsed position;

each of said frame members comprising a plurality of frame portions, each of said frame portions being selectively coupled to at least one other of said frame portions of the associated one of said frame members to form the associated one of said frame members to be extended through said side members and said panel member when said frame assembly is being actuated to said deployed position, said frame portions of each of said frame members being separated when said frame assembly is actuated to said collapsed position;

each of said frame members comprising at least one elastic member, said elastic member being coupled to said frame portions of each of said frame members, said elastic member being for inhibiting loss of one of said frame portions from the associated one of said frame members when said frame portions are separated;

said panel member comprising a flexible material, said flexible material being folded to facilitate storage of said panel member when said frame assembly is actuated to said collapsed position; and a bag member selectively receiving said panel member and said frame assembly when said frame assembly has been actuated to said collapsed position, said bag member facilitating storing of said panel member and said frame assembly when said frame assembly and said panel member are not in use.

14. A collapsible headboard for use with a mattress to keep pillows on the mattress, the collapsible headboard comprising:

a frame assembly being selectively actuated between a collapsed position and a deployed position, said frame assembly being adapted for receiving the mattress when said frame assembly is in said deployed position, said frame assembly being actuated to said collapsed position for facilitating storage of said frame assembly when said frame assembly is removed from the mattress;

a panel member being coupled to said frame assembly, said panel member being adapted for being positioned against the mattress such that said panel member is for inhibiting pillows from sliding off of the mattress when said frame assembly is in said deployed position;

said frame assembly comprising a pair of side members, each of said side members being positioned in a spaced relationship such that said panel member extends between said side members of said frame assembly, each of said side members being adapted for being positioned on opposite, sides of the mattress such that said side members position said panel member against the mattress to inhibit the pillows from falling off the mattress when said frame assembly is in said deployed position;

said frame assembly comprising a plurality of frame members, each of said frame members being extended through said side members and said panel member such that said frame members maintain the spaced relationship of said side members of said frame assembly, said frame members being removed from said side members and said panel member when said frame assembly is being actuated to said collapsed position;

each of said frame members comprising a plurality of frame portions, each of said frame portions being selectively coupled to at least one other of said frame portions of the associated one of said frame members to form the associated one of said frame members to be extended through said side members and said panel member when said frame assembly is being actuated to said deployed position, said frame portions of each of said frame members being separated when said frame assembly is actuated to said collapsed position; and each of said frame members comprising at least one elastic member, said elastic member being coupled to said frame portions of each of said frame members, said elastic member being for inhibiting loss of one of said frame portions from the associated one of said frame members when said frame portions are separated.

15. The collapsible headboard as set forth in claim 14, further comprising:

each of said side members comprising a plurality of side portions, each of said side portions being pivotally coupled to an adjacent one of said side portions such that said side portions pivot with respect to each other to permit said frame assembly to be actuated between said deployed position and said collapsed position.

16. The collapsible headboard as set forth in claim 14, further comprising:

said backing panel portion of said panel member extending between said side members of said frame assembly, said backing panel portion being adapted for extending upwardly from a support surface such that said backing panel portion is positioned adjacent a head of the mattress to inhibit the pillows from being pushed off the head of the mattress when said frame assembly is in said deployed position.

17. The collapsible headboard as set forth in claim 14, further comprising:

said bottom panel portion of said panel member extending between said side members of said frame assembly, said bottom panel portion being adapted for being positioned parallel to the support surface such that said bottom panel portion is for being positioned under the mattress to inhibit movement of said frame assembly and said panel member with respect to the mattress when said frame assembly is in said deployed position.

18. The collapsible headboard as set forth in claim 17, further comprising:

said bottom panel portion of said panel member comprising a friction enhancing material, said friction enhancing material being adapted for increasing friction between said bottom panel portion and the mattress to inhibit the mattress from sliding on said bottom panel portion.

19. The collapsible headboard as set forth in claim 14, further comprising:

said panel member comprising a pair of side panel portions, each of said side members of said frame assembly being positioned in said side panel portions of said panel member such that said side panel portions are adapted for inhibiting portions of a user becoming pinched by said side members when said frame assembly is actuated between said deployed position and said collapsed position.

20. The collapsible headboard as sat forth in claim 14, further comprising:

said panel member comprising a flexible material, said flexible material being folded to facilitate storage of said panel member when said frame assembly is actuated to said collapsed position.

* * * * *